United States Patent [19]

Pappanikolaou

[11] 4,068,675

[45] Jan. 17, 1978

[54] INFLATABLE UMBRELLA

[76] Inventor: George Pappanikolaou, 621 90th St., Brooklyn, New York, N.Y. 11228

[21] Appl. No.: 695,640

[22] Filed: June 14, 1976

[51] Int. Cl.[2] ..... A45B 19/02

[52] U.S. Cl. ..... 135/20 B; 92/89; 135/39

[58] Field of Search ..... 135/20 B, 39; 60/404, 60/533, 584; 92/89, 98 R, 99

[56] References Cited

U.S. PATENT DOCUMENTS

| | | | |
|---|---|---|---|
| 811,330 | 1/1906 | Roth | 92/99 |
| 1,411,560 | 4/1922 | Beaty | 135/20 B |
| 2,753,878 | 7/1956 | Halberstam | 135/20 B |
| 2,798,764 | 7/1957 | Ray | 60/533 |
| 2,827,066 | 3/1958 | Nussbaumer | 135/20 B |
| 3,053,266 | 9/1962 | Burns | 135/20 B |
| 3,070,029 | 12/1962 | Russell | 92/99 |
| 3,269,276 | 8/1966 | Natanson | 60/533 |
| 3,361,145 | 1/1968 | Jones | 136/20 B |

*Primary Examiner*—Werner H. Schroeder
*Assistant Examiner*—Conrad L. Berman
*Attorney, Agent, or Firm*—Lackenbach, Lilling & Siegel

[57] ABSTRACT

An inflatable umbrella comprising a flexible canopy having at least one enclosed space adapted to be filled with a fluid for inflating the umbrella to an open condition. A self-contained compressible reservoir containing a fluid supply communicates with the enclosed space, and means are provided for compressing said reservoir, which may either be of the manual or automatic type.

25 Claims, 6 Drawing Figures

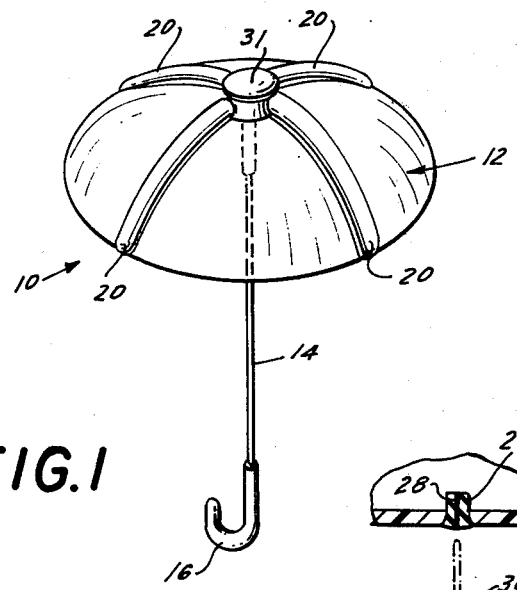
FIG. 1
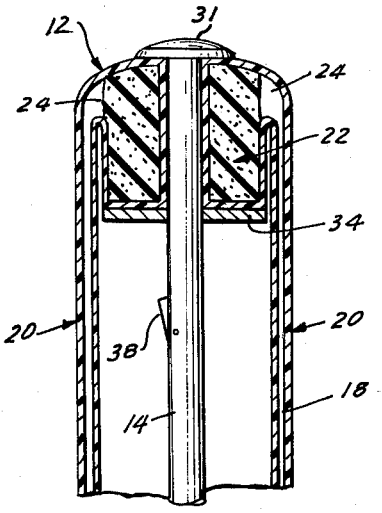
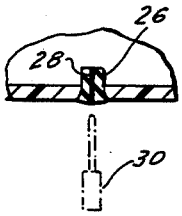
FIG. 6
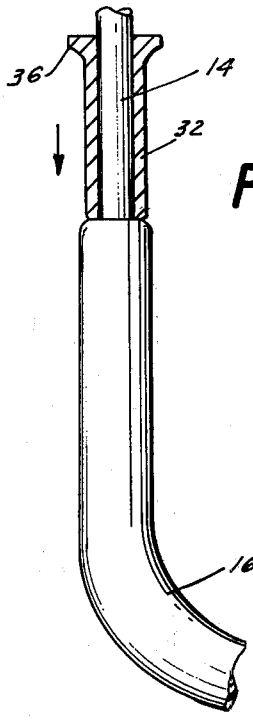
FIG. 2
FIG. 4
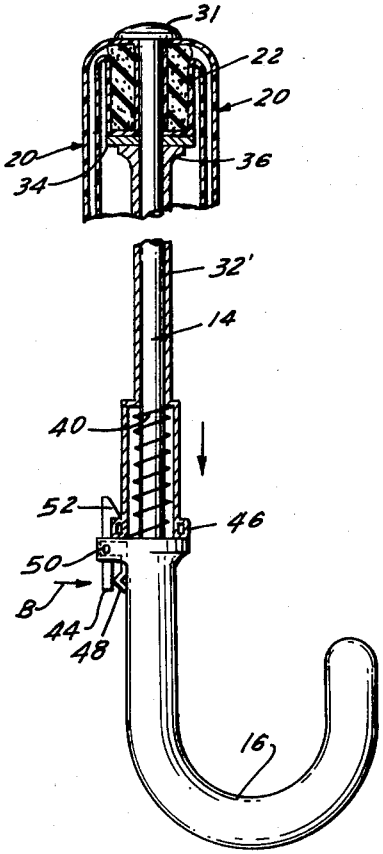
FIG. 5
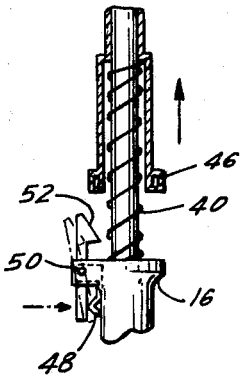
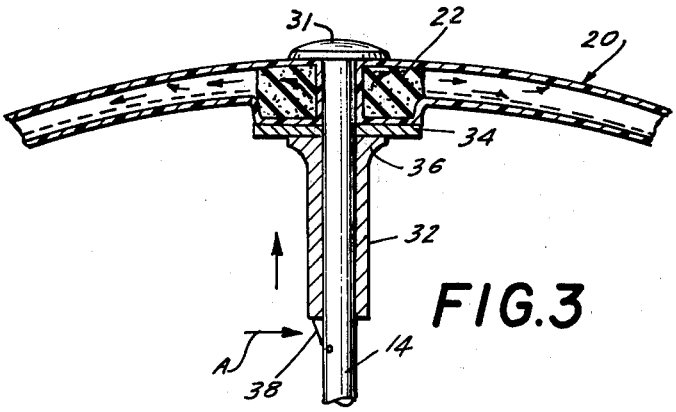
FIG. 3

INFLATABLE UMBRELLA

BACKGROUND AND SUMMARY OF THE INVENTION

The present invention relates to an inflatable umbrella, and more particularly to an improved, relatively lightweight umbrella having passage means and having a self-contained fluid reservoir for pressurizing the passage means and inflating the umbrella.

Heretofore in the art, umbrellas primarily employ a fabric or plastic covering and utilize metal ribs which hold the umbrella in an open shielding position and which collapse to form a closed, folded position. These metal ribs are generally expensive and difficult to manufacture and are destroyed if a gust of wind causes the umbrella to turn inside out. Moreover, as the metal ribs utilize considerable space and restrict the area beneath the canopy, they limit full utilization of the space beneath the canopy, for purposes of shielding one's head, shoulders, and substantial portions of one's body from inclement weather.

Umbrellas of the prior art include the following United States patents, all of which teach inflatable umbrellas having a pumping device or mechanism for inflating purposes, such as U.S. Pat. Nos. 883,277; 1,411,560; 2,625,946; 2,753,878; 2,810,391; 2,827,066; 3,053,266 and 3,802,451. In all of the prior art references, the pump mechanism is a part of the handle of the umbrella.

Other United States patents, such as U.S. Pat. Nos. 2,401,252; 2,679,256; 2,863,467; 3,361,145 and 3,683,947 pertain to inflatable umbrellas which are provided with an air valve by which the inflating fluid is admitted to inflate the umbrellas.

In yet another United States patents, umbrella structures are taught which are erected by ribs filled with air, such as U.S. Pat. Nos. 3,364,631; 3,706,160; 3,863,661 and 3,889,700.

Of all of these references, none teach the novel use of a self-contained, built-in air reservoir comprising a sponge-like reservoir adapted to store air and release same upon pressure to a sealed chamber or passageway.

Accordingly, it is a principal object of the present invention to provide a new and improved umbrella construction, which is inflatable by air stored in a self-contained reservoir.

It is another object of the invention to provide an umbrella construction wherein the structure may comprise either a manual or automatic opening mechanism.

It is a further object of the invention to provide an umbrella construction which is relatively lightweight in construction, economical to manufacture and one which can be quickly and easily inflated when desired to be used.

Consequently, in accordance with the present invention, there is provided an inflatable umbrella comprising a flexible canopy having at least one enclosed space adapted to be filled with a fluid for inflating the umbrella to an open condition. A self-contained compressible fluid reservoir containing a fluid supply commensurate with the enclosed space, and means are provided for compressing the reservoir, which may be either of the manual type or of the automatic type.

These and other objects, features and advantages of the invention, will be more fully appreciated by reference to the following detailed description of the preferred embodiments of the present invention, when taken in conjunction with the accompanying drawings, wherein like reference characters refer to similar parts throughout the several views of figures of the drawings.

BRIEF DESCRIPTION OF THE DRAWINGS

FIG. 1 is a perspective view of an inflatable umbrella made in accordance with the teachings of the present invention;

FIG. 2 is a fragmentary sectional view of the elongated central staff or shaft, broken away in two places, and illustrating the umbrella in the collapsed condition;

FIG. 3 is another fragmentary sectional view of the upper end portion of the umbrella, but with the umbrella in an inflated condition;

FIG. 4 is an alternate embodiment of the umbrella construction, shown in a collapsed condition, but with a resilient quick release device or mechanism for automatically inflating the umbrella shown in a locked position;

FIG. 5 is a fragmentary sectional view of the alternate umbrella construction, but showing the unlocked position of the release device and the compression spring in an expanding condition; and FIG. 6 is a fragmentary, sectional view of a fluid valve, which may be employed in the umbrella construction for replenishing the air reservoir should same be desired or necessary.

DESCRIPTION OF THE PREFERRED EMBODIMENTS OF THE INVENTION

Referring now to the drawings and more particularly to FIGS. 1–3, there is shown an inflatable umbrella 10 having a ribbed canopy portion 12 which is generally fabricated from a thin, impervious, flexible plastic sheet such as polyvinyl film, or polypropylene film which are suitable for fabrication by heat sealing or by adhesives in a manner conventionally well known in the trade. The umbrella 10 also includes a central elongated staff or shaft portion 14, which, if desired, may terminate at its lower end in a small curved handle 16. Although not shown, the staff 14 may be of a telescoping type so as to enable the umbrella 10 to be folded for storage to a relatively small compact bundle adapted to be carried about one's person or in a purse or attache case, if desired. The canopy portion 12 may be of a transparent material, and it may be of a desired size or shape and the type of umbrella may also be of the simple convex type, flat type or even the pagoda type.

The canopy 12 includes at least one enclosed air space 18, which may be in the form of a single hollow continuous rib, such as a spiral rib; or a plurality of interconnected hollow ribs or it may be in the form of a single large air chamber (not shown), such as may be comprised between two plastic sheets sealingly connected together solely about their peripheries.

In the preferred embodiment of the invention as shown herein at least three or four hollow ribs 20 are interconnected at the center portion of the umbrella 10 to an air reservoir 22. The four hollow ribs 20 are formed from the plastic film 12 and are suitably sealed from leakage, except for the opening 24 which communicates with the air reservoir 22. This reservoir 22 comprises a porous, resilient material capable of storing a large volume of air or other suitable inflating fluid. Any sponge rubber-like material or other cellular foamed plastic material capable of storing a large volume of air in a normal uncompressed condition and capable of releasing such air upon being compressed could be satisfactorily employed in the practice of the invention. The material must be capable of returning to its uncompressed condition in such a manner that its resiliency is capable of generating a vacuum or negative pressure in the enclosed space and/or air passageways, whereby the air in the ribs 20 of the umbrella 10 is sucked back into the air reservoir 22 for storage and future use when the umbrella is again desired to be used. It will be appreciated that anything which is inflated under pressure will tend to deflate over a period of time depending upon the porosity of the containing material. The greater the pressure, the faster diffusion takes place, unless, of course, the material is absolutely leak-proof and impervious that not even a single molecule can penetrate the material. In the present invention, such a condition should not exist, as an umbrella is deflated or in a closed condition most of the time. However, a conventional fluid valve 26, as best shown in FIG. 6, may be used, if desired, for replacing or replenishing any fluid or air lost from the sealed system and air reservoir 22. This simple valve 26 is generally made of a resilient material and is provided with a self-closing opening 28 which closes automatically upon withdrawal of a needle 30 (shown in phantom) which may be used to re-pressurize the air reservoir 22. This fluid valve 26 may be placed in a wall of one of the ribs 20 or it may be attached directly to the air reservoir 22, for example, at the very top of the umbrella 10 near the center portion thereof, or at any other location, which would enable a needle valve to be conveniently utilized for repumping air into the system or directly into the reservoir 22.

The air reservoir 22 is compressed primarily against the underside of a stationary shaft cover 31, for example, manually by a slidable tube-like element 32, which acts against a pressure-plate 34 suitably secured to the bottom portion of the air reservoir 22. At the upper end 36 of the element 32, a radially outwardly extending flange may be provided, if desired, and it can be made sufficiently large enough in diameter to be used alone, in lieu of with a pressure plate for bearing against the air reservoir 22 so as to compress same and force the stored air into the ribs 20 for inflating the umbrella 10. However, a thin disk-like pressure plate 34 is preferred as it ensures a more uniform pressure distribution across the entire cross-sectional area of the air reservoir 22.

The slide element 32 is conveniently held stationary in place in its working relationship with the air reservoir 22, by means of a pivoted, spring-loaded locking wing or element 38 located in the shaft 14. As best shown in FIG. 3, the slide element 32 is shown held up in place by the locking wing or element 38, and the umbrella 10 is fully inflated with most, if not all, of the air in the ribs 20. To close the open umbrella 10, one simply presses the pivoted spring-loaded locking element 38 into the shaft, as shown by the arrow A in FIG. 3, and the slidable element 32 is pulled down or drops down automatically due to gravity until it rests against the handle 16, as shown in FIG. 2. As the air reservoir 22 expands back to its normal uncompressed condition, it removes the air from the air ribs 20, as noted hereinabove, thus causing the umbrella 10 to collapse into a closed condition.

In the alternate embodiment of FIGS. 4 and 5, the slidable element 32' is spring-loaded by means of a compression spring 40 and thus need not be manually forced up the shaft 14. The element 32' moves up the shaft a distance which is the amount of compression of the air reservoir 22, and thus the spring 40 holds the canopy 12 in an open condition on the shaft 14 in a manner like the locking element used in connection with the embodiment of FIGS. 1–3. A pivoted latching device 42 holds down the slide element 32' by means of a hook-like element 44 which locks onto a flange base portion 46 of the slide element 32'. When pressing the lower end of the hook-like element 44 in the direction of the arrow B, it bears against a spring-like element 48 of U-shape configuration having an extending portion with a notched-like end. This spring element 48 is simply connected to a pin 50 about which the hook-like element 44 is connected and it urges the upper latch end portion 52 thereof to engage the flange 46 of the slide element 32' so as to maintain the umbrella 10 in a normally closed position. Upon pressure applied at B, the notch-like end portion yields, thereby permitting the element 48 to pivot outwardly away from the shaft 14 so as to release the slide element 32'.

It should also be appreciated that although the ribs 20 radiate out from the center of the canopy 12, a single continuous rib spiralling from the center to the peripheral edge would likewise serve the same purpose. Alternately, a single diameteric rib passing through the center of the umbrella from one edge to the other edge may also be sufficient when inflated to open the umbrella to a fully open condition. Another rib system may comprise on one or more circular ribs and one or more radial ribs interconnected together, whereby the radial rib is the passageway within which the air travels to the circular rib for inflating the umbrella. In the broadest embodiment of the invention, a single enclosed chamber or space is disposed between the walls of the plastic film and this single entire chamber or space is inflated as no ribs or tubular passageways exist as such with this type of structure. Although the enclosed space which is inflated may comprise passageways also, it is important that the enclosed space or air chamber be of a predetermined size or area of sufficient volume and that when pressurized with air, the umbrella is caused to open up to a fully extended open condition.

While the invention has been described, disclosed, illustrated and shown in terms of an embodiment or modification which it has assumed in practice, the scope of the invention should not be deemed to be limited by the precise embodiment or modification herein described, disclosed, illustrated or shown, such other embodiments or modifications as may be suggested to those having the benefit of the teachings herein being intended to be reserved especially as they fall within the scope and breadth of the claims here appended.

What is claimed is:

1. An umbrella having a shaft and handle portion comprising: a flexible canopy having an inflatable enclosed space forming a part of said canopy; and having a self-contained compressible fluid reservoir containing a generally permanently closed or sealed fluid supply system communicating with said enclosed space; and means for compressing said fluid reservoir, whereby upon compression said fluid is forced into said enclosed space thereby inflating said canopy of said umbrella, and restoration means expanding said fluid reservoir thereby evacuating said enclosed space to deflate said canopy.

2. The umbrella according to claim 1, wherein said enclosed space comprises at least a single passage means.

3. The umbrella according to claim 1, wherein said enclosed space comprises a plurality of passage means interconnected with each other and to said fluid reservoir.

4. The umbrella according to claim 3, wherein said passage means extend from said fluid reservoir to a location remote from said fluid reservoir.

5. The umbrella according to claim 4, wherein said passage means are four in number and all of said passage means extend from about the center of said canopy to generally about the outermost peripheral edge of said canopy.

6. The umbrella according to claim 1, wherein said fluid reservoir comprises a resilient, porous body containing said fluid supply; and said body being expanded in its normal condition when said umbrella is normally closed, and said body being compressed in its alternate condition when said umbrella is normally open.

7. The umbrella according to claim 6, wherein said fluid reservoir is a porous sponge-like material, and when said fluid reservoir is in its expanded normal condition, it is capable of removing a predetermined quantity of fluid from said enclosed space so as to cause said umbrella to deflate and collapse to a generally closed condition.

8. The umbrella according to claim 6, wherein said fluid reservoir is a porous sponge-like material, and when said fluid reservoir is in its compressed alternate condition, it is capable of forcing by compression a predetermined quantity of fluid into said enclosed space so as to cause said umbrella to inflate to a generally full open condition.

9. An umbrella having a shaft and handle portion comprising: a flexible canopy having an inflatable enclosed space forming a part of said canopy; a fluid filled compressible, permanently sealed enclosure in communication with said enclosed space; resilient transferring means transferring said fluid between said compressible enclosure and said enclosed space when compressed; and when released said fluid is transferred back to said compressible enclosure.

10. An umbrella having a shaft and handle portion comprising: a flexible canopy and fluid filled enclosed permanently sealed space having a portion containing restoring means and an inflatable portion, and means for transferring said fluid therebetween with cooperation from said restoring means so that in one condition of said restoring means, the canopy of said umbrella is deflated and in a generally closed condition, and in the alternate condition of said restoring means, said canopy of said umbrella is inflated and in a generally open condition.

11. An umbrella having a shaft and handle portion comprising: a flexible canopy having an inflatable enclosed space forming a part of said canopy; a compressible, permanently sealed enclosure communicating with said enclosed space of said flexible canopy; a fluid supply in said enclosure and said enclosed space; and restoration means urging said compressible enclosure to its maximum volume; said fluid supply being of a volume sufficient to provide a fully inflatable enclosed space for opening said flexible canopy to a generally open condition; and means squeezing said compressible enclosure so as to force said fluid in said compressible enclosure into said enclosed space.

12. The umbrella according to claim 11, further including a pair of surfaces, one surface of which is disposed in juxtaposition to said compressible enclosure, and the other surface is adapted to be manipulated to bear against said other one surface for forcing said compressible enclosure to its squeezed condition.

13. The umbrella according to claim 25, wherein said other surface comprises a movable slide member mounted on said shaft.

14. The umbrella according to claim 20, wherein said movable slide member is biased.

15. The umbrella according to claim 14, including releasable latching means for holding said movable slide member in a position which does not exert a force against said one surface.

16. An umbrella having a shaft and handle portion comprising: a self-contained, generally permanently closed fluid system communicating with enclosed space in a canopy, a variable volume fluid reservoir adapted for fluid transference, means for minimizing the volume of said fluid reservoir, restoring means for expanding the volume of the fluid reservoir, said enclosed space being in communication with said fluid reservoir for bilateral fluid transference between both said enclosed space and said fluid reservoir; said enclosed space mutually cooperatively associated with said canopy so that when said fluid is transferred to said enclosed space, said canopy forms a generally rigid extended open configuration, and when said fluid is transferred to said fluid reservoir, said canopy forms a generally collapsed contracted closed configuration.

17. The umbrella according to claim 16, wherein said restoring means is resilient.

18. The umbrella according to claim 17, wherein said restoring means is porous.

19. The umbrella according to claim 18, wherein said fluid is a liquid.

20. The umbrella according to claim 18, wherein said fluid is a gas.

21. The umbrella according to claim 18, wherein said fluid is a mixture of liquid and gas.

22. The umbrella according to claim 16, including valve means for optimum adjustment of said self-contained, generally closed fluid system.

23. The umbrella according to claim 16, including releasable holding means for holding said umbrella in said generally rigid, extended open configuration.

24. The umbrella according to claim 23, including biasing means for transferring said fluid from said fluid reservoir to said enclosed space.

25. The umbrella according to claim 24, including releasable holding means for holding said biasing means when said umbrella is in said generally collapsed contracted closed configuration.

* * * * *

UNITED STATES PATENT AND TRADEMARK OFFICE

CERTIFICATE OF CORRECTION

PATENT NO. : 4,068,675

DATED : January 17, 1978

INVENTOR(S) : George Pappanikolaou

It is certified that error appears in the above-identified patent and that said Letters Patent are hereby corrected as shown below:

The title page should be deleted and the attached page substituted therefor.

In column 6, last page, change Claims 13 and 14 to read on the previous claims, claims 12 and 13 respectively.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*

United States Patent [19]

Pappanikolaou

[11] 4,068,675

[45] Jan. 17, 1978

[54] INFLATABLE UMBRELLA

[76] Inventor: George Pappanikolaou, 621 90th St., Brooklyn, New York, N.Y. 11228

[21] Appl. No.: 695,640

[22] Filed: June 14, 1976

[51] Int. Cl.[2] ..... A45B 19/02

[52] U.S. Cl. ..... 135/20 B; 92/89; 135/39

[58] Field of Search ..... 135/20 B, 39; 60/404, 60/533, 584; 92/89, 98 R, 99

[56] References Cited

U.S. PATENT DOCUMENTS

| | | | |
|---|---|---|---|
| 811,330 | 1/1906 | Roth | 92/99 |
| 1,411,560 | 4/1922 | Beaty | 135/20 B |
| 2,753,878 | 7/1956 | Halberstam | 135/20 B |
| 2,798,764 | 7/1957 | Ray | 60/533 |
| 2,827,066 | 3/1958 | Nussbaumer | 135/20 B |
| 3,053,266 | 9/1962 | Burns | 135/20 B |
| 3,070,029 | 12/1962 | Russell | 92/99 |
| 3,269,276 | 8/1966 | Natanson | 60/533 |
| 3,361,145 | 1/1968 | Jones | 136/20 B |

*Primary Examiner*—Werner H. Schroeder
*Assistant Examiner*—Conrad L. Berman
*Attorney, Agent, or Firm*—Lackenbach, Lilling & Siegel

[57] ABSTRACT

An inflatable umbrella comprising a flexible canopy having at least one enclosed space adapted to be filled with a fluid for inflating the umbrella to an open condition. A self-contained compressible reservoir containing a fluid supply communicates with the enclosed space, and means are provided for compressing said reservoir, which may either be of the manual or automatic type.

25 Claims, 6 Drawing Figures

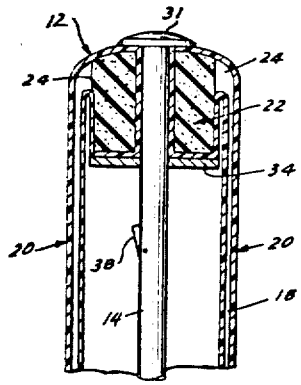

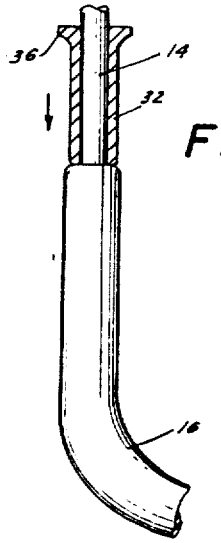

FIG. 2